US005173198A

United States Patent [19]

Blum

[11] Patent Number: 5,173,198

[45] Date of Patent: Dec. 22, 1992

[54] DEVICES USED FOR TEEMING LIQUID METALS

[75] Inventor: Ferdinand P. Blum, Echternach, Luxembourg

[73] Assignee: Arbed S.A., Luxembourg

[21] Appl. No.: 714,788

[22] Filed: Jun. 12, 1991

[30] Foreign Application Priority Data

Jun. 20, 1990 [LU] Luxembourg ..... 87752

[51] Int. Cl.[5] ..... B22D 41/34

[52] U.S. Cl. ..... 222/600; 266/236

[58] Field of Search ..... 266/236; 222/600

[56] References Cited

FOREIGN PATENT DOCUMENTS 1200384 2/1986 Canada .
1201013 9/1965 Fed. Rep. of Germany .
1514434 1/1968 France .
1159118 7/1969 United Kingdom .
2160952 1/1986 United Kingdom ..... 222/600

*Primary Examiner*—Melvyn J. Andrews
*Attorney, Agent, or Firm*—Fishman, Dionne & Cantor

[57] ABSTRACT

An improved device used for teeming liquid metal out of a metallurgical container comprises an efficacious cross section which is formed by the surface of the discharge channel available for the outflow of the metal during the progressive opening of the upper outflow passage. This efficacious cross section is initially kept small and over at least a noticeable part of its length the discharge channel is provided with an active passage portion showing a shaped cross section. This shaped portion stretches down to the lower extremity of the channel and has a form comparable to that one of a star with three to four branches, whereas the grounds of these branches extend axially in the direction of the outflow and serve as guides to the metal during its discharge.

9 Claims, 1 Drawing Sheet

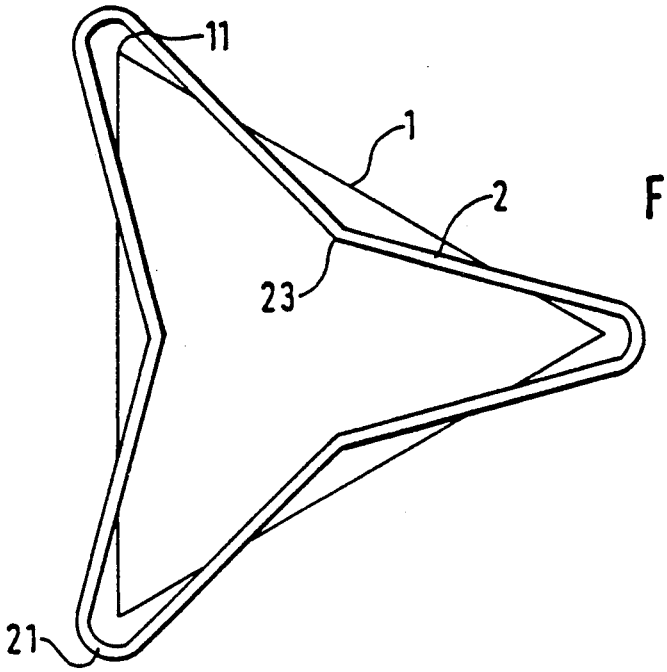
Fig. 1
Fig. 2
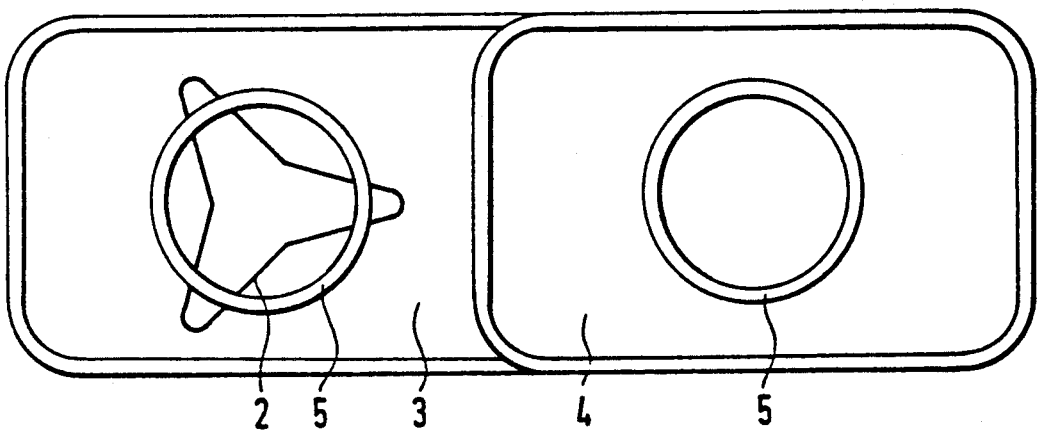
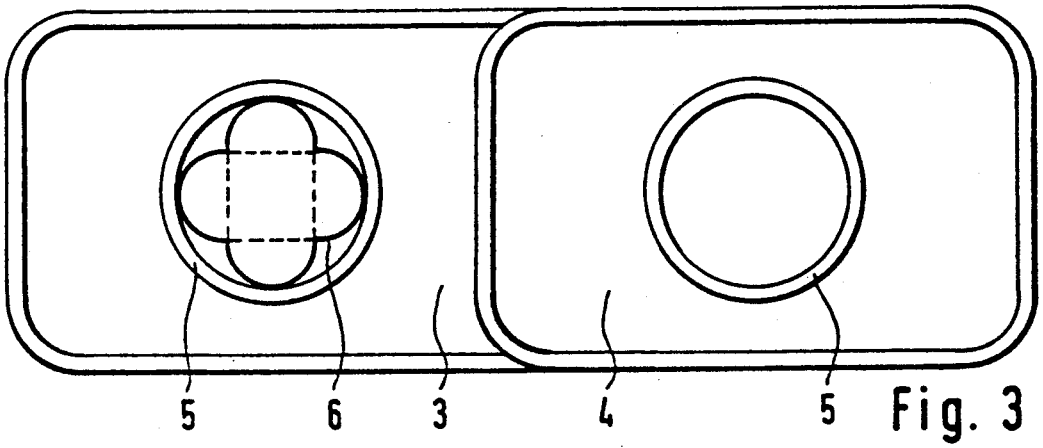
Fig. 3

DEVICES USED FOR TEEMING LIQUID METALS

TECHNICAL FIELD

The present invention relates to improved devices for use in tapping liquid metal from an metallurgical container into another container, e.g. into a treatment or a transfer vessel or into an enclosure wherein the metal is allowed to solidify.

BACKGROUND OF THE INVENTION

In metallurgy a rather great importance is attached to the various funnel like tapping spouts which are used to temporarily delimit the streams of the molten metals during their discharge from one container into another.

The concerned containers are, e.g. refining converters, electric elaboration or treatment furnaces, transfer and alloying ladles, and continuous casting tundishes. The devices used for teeming the liquid metal may be conventional discharge nozzles which are opened and closed with the help of a stopper rod. However, sliding or rotating gate nozzles or valves of the different known types, hereinafter generically called slide gate valves, have now become popular.

The reason is not only an ergonomic one or an economic one due to the fact that it is imperative to be in a position to realize any of the mentioned handlings with the smallest possible danger for the operators and to achieve moreover the best possible yield of the different operations; consideration has also to be given to the metallurgical consequences resulting from the manner in which a nozzle and stopper rod device or a slide gate valve are behaving during their use, that is to say that will be the configuration of the metal stream which is being bundled in the outflow channel of the tapping spout. Unless a very special treatment is requiring a sputtering jet, the metallurgists made as a rule all required efforts in order to obtain close, smooth and laminar outflowing streams. However this is in fact not so easy and very often a sputtering, open and turbulent jet, sometimes called "umbrella jet", is obtained either at the start of the teeming or during the course of the discharge operation. Even if, up to now, the real reasons of the formation of the "umbrella jet" were not exactly known, the metallurgists however knew very well the deleterious metallurgical effects of this phenomenon.

So, in the iron and steel making industry, as well as in the field of the traditional casting into ingot molds, as in the field of the continuous casting, a turbulent stream entraps considerable volumes of air. As a result thereof the metal, in the present case steel, is exposed to an oxidation. The oxidation of the outer skin of the stream results in an increase of the inclusions in the finished product and it is therefore responsible for the negative consequential effect on the degree of the inner purity of the metal, which on the other hand influences the properties of the finished product and its transformality. In the case of the ingot casting the turbulent stream causes moreover in the interior of the ingot mold a foaming and a splashing. The upwardly projected drops of metal solidify untimely along the wall of the ingot mold and are responsible for an insufficient surface quality which leads to rolling defects and faults. If during continuous casting, be it in the case of the outflow of a free or of an unprotected stream, be it in the case of an immersed or of a protected stream, the metal flows in a turbulent manner into the upper part of the mold, it becomes impossible to keep the meniscus more or less constant and motionless. This results in an uncontrolled dragging of slag and in corresponding surface defects on the cast slabs, blooms or billets, as well as in oxide inclusions in the steel.

These uncontrolled occurrences of a turbulent outflow condition have led the metallurgists to take several empiric preventative measures. For example, it have been suggested to use nozzles with a varying ratio "length of the nozzle" to "diameter of the outlet", or to modify the shape and the composition of given parts of the nozzle, especially of the movable parts, or to exchange more frequently the parts of the nozzle subject to wear.

More specifically, Canadian Patent No. 1,200,384 describes a complete sliding closure device for the taphole of a steel shop ladle. This device is characterized by the fact that it comprises a fixed upper part showing a passage of a round cross section and a movable lower part comprising an orifice with a cross section of the shape of an equilateral triangle. The base of the triangle is small and has approximately the same dimension as the diameter of the round passage in the upper device part, whereas the bisector of the triangle coincides with the opening and the closure paths of the device. In view of the closure the lower movable nozzle bearing part of the device is moved in the direction of the apex of the equilateral triangle. This means that, as well in the case of the closure, as in the case of the opening of the device, the terminal part of the jet in the process of being interrupted or respectively the initial part of the jet in the course of being generated are very important. Halfway of the path of the movable lower nozzle bearing part before the passage in the lower fixed part of the device, it is one half of the total outflow section which is uncovered. The vanishing or the nascent streams are directed into the trough gutter which has the same vee-form as the apex of the cross section form of the nozzle. As they flow out those streams give rise to turbulences and to rather important sputtering.

BRIEF DESCRIPTION OF THE INVENTION

In order to avoid all these drawbacks, as well those of practical nature as those of metallurgical character, it is the aim of the present invention to provide an improved teeming device, which is capable of generating an outflowing stream of a laminar type under any continuous or discontinuous operating condition and which consequently allows to reduce the frequency and the importance of the surface defects and of the inner imperfections of the cast product.

This aim is fully achieved thanks to a teeming device which is characterized in that the efficacious cross section of the device, which is formed by the surface of the discharge channel available for the outflow of the metal during the progressive opening of the outflow passage, is initially kept small and in that over at least a noticeable part of its length the discharge channel is provided with a shaped active portion, the profile of this portion stretching down to the lower extremity of the channel and having a form comparable to that one of a star with three or four branches, the grounds of these branches extending axially in the direction of the outflow and serving as guides to the metal during its discharge.

According to a possible embodiment of the invention the grounds of the branches of the star profile, that is to say the radial extremities of the radii of the arms of the star, extend in some way like trough gutters axially in the direction of the channel through which the metal is discharged. Apart from a possibly nonprofiled and occasionally flared out upper part of the discharge channel, the profile extends over a very substantial part of the length of the channel and in any case it reaches down to the very extremity of the channel. The aforementioned radii of the star-shaped profile define between themselves an obtuse angle in the case of the star with three branches and a straight angle in the case of the star with four branches, the latter branches having basis parts of a square or of a rectangular cross section. This means that the cross sections have in fact substantially the shape of triangles and of crosses. During the operation these shapes round off by themselves due to the erosion. However, it is also possible to foresee during the manufacturing of these devices such rounded off basis parts for the axial trough gutters of the stars with three or four radii, whereas the intersecting walls of the star branches defined obtuse angles in the case of the triangular profiles and right angles in the case of the cross-shaped profiles. If an insufficient wear resistant material is selected and if the edges of the cross-shaped profile is eaten away until a more or less square profile is formed, the beneficial effects due to the special measures according to the invention are completely lost.

The best results are achieved if the profile of the discharge channel in the lower plate of the slide gate valve is oriented in such a way with respect to the movable part of the device, which will slide or rotate, that a sharp-pointed edge of the profile will be opened first during the relative opening movements of the respective parts of the slide gate valve. The said angular edge will consequently be oriented substantially in the direction of the movement if the lower plate, which bears the nozzle part with the profiled channel, is the movable part, whereas the said edge will be oriented in the direction opposite to that one of the movement if a movable upper plate constitutes the closing part of the device. In the case of the cross-shaped profile the axis of the cross may be rotated by a given angle, for example, 45°, with respect to the aperture-closure direction. If one projects the profile of the passage in the upper part of a slide gate valve on the profile of the lower part thereof and if the movable part has covered exactly one half of the opening trajectory, one will see that the profiled cross section of the discharge channel is still rather far away from being half open and the situation is the same for the circular cross section of the passage in the other part of the device. In opposition hereto, at least 50% of the discharge cross section of the device according to the Canadian Patent No. 1,200,384 are laid bare if the two gates have covered 50% of the distance of the opening trajectory.

According to the present invention it is also foreseen that the area of the profile at the entrance of the discharge channel is at least equal to the area of the profile at the level where the stream comes out of the nozzle, the first named area being preferably 10% to 15% larger than the last named area. If a nozzle closed by a stopper rod device is used, the upper face of the nozzle part will be provided with a seat for the stopper, this seat having a round edge corresponding to the shape of the stopper and being larger than the average channel diameter. In the case of a slide gate valve the upper extremity of the discharge channel may be flared, whereas the lower profiled section or portion will have preferably a constant diameter. In this latter case the ratio of the profile area at the outlet passage of the upper part of the device and the average profile area of the lower part of the device vary more or less within the limits quoted already for the ratio of the upper and lower profile areas of the shaped discharge part itself. This means that the cross sections do not remain constant over the whole length of the device, they decrease from the upper to the outflow side of the device.

The detailed analysis of the positive results obtained thanks to the device according to the invention and the simulation studies executed for both the traditional and the new slide gate valves have allowed to gain a somewhat deeper insight into the phenomenon of the bursting of the outflowing stream and of the formation of the "umbrella jet", both phenomena being now liable to be reconstituted by simulation. So, the bursting of the stream comprises two phases, namely:

at the early stage the progressive opening of the nozzle part of the device the nascent stream is still non homogeneous and unsymmetrical and the outflow channel is only partially filled with liquid metal. Metal spatter and drops are generated, but neither the real stream nor the "umbrella jet" are yet formed; when the gates are sufficiently open (approximately 50%) the outstreaming jet is more or less centered, but it is invariably rotating at a high speed in the case of the traditional devices with round or oval outflow channels. If the surface tension of the metal is not any longer high enough to keep the stream coherent and closed, the rotation is transformed into rectilinear movements following the tangents and the "umbrella" appears at about 15 to 20 cm below the outlet of the nozzle.

Whereas it is not possible to avoid completely the first phenomenon resulting mainly from the non symmetrical admission of the metal into the discharge nozzle, it can nevertheless be substantially attenuated according to the present invention by giving to one branch of the special star-shaped profile of the outflow channel a specific orientation with respect to the opening movement of the gates of a slide gate valve. The said branch is oriented in such a way that at the beginning of the casting there is a small efficacious outflow cross section—as compared to the conventional casting—and that thereafter the free passage is becoming progressively, not abruptly, greater. The most spectacular improvement has however been achieved in the field of the most considerable perturbation which consists in the "umbrella formation" and which is obviously responsible for most of the inner and the outer defects of the product. As a consequence of the already mentioned suppression of the rotation of the stream one achieves an axial guiding which makes that the steel now comes out straight-line of the discharge channel of the nozzle part of the device. This is due to the fact that the metal entering into the discharge channel is concentrated in the corners which are oriented differently as the aperture through which the metal is flowing laterally into the said channel. Thus the inflowing metal stream is given in the profiled channel section or portion another than a round shape and the rotation of the outflowing stream is successfully avoided. One now understands easily that a too important wear of the profiled channel can lead to a cross section-shape which is not able to abolish the rotation so completely. This also explains that out of the substantially cross-shaped and the triangular profiles, the triangular shape is slightly more efficacious. Indeed the axially extending grooves of the triangular channel section can have a more pronounced annularity and/or depth without being so rapidly worn away. The situation is somewhat different for the cross-shaped channel section. The latter ends up in a substantially square channel portion as an important material wear results in a rapid abrading of the projecting inner edges of the cross. In this case, towards the end of the casting, the stream is not any longer so well guided in a channel becoming more and more square and the suppression of the rotation is less pronounced. For the said cross-shape the wear resistance of the material is consequently of a particular importance as the casting conditions are depending on this resistance.

In the light of these explanations it appears that a teeming device must not necessarily present the specific geometry of its cross section over the whole length of the discharge channel. It is however of the most outstanding importance that the terminal part of the discharge channel of the teeming device presents this geometry. As a rule the shaped section extends over a part of the total length of the channel which amounts to at least 50% and preferably even to more than 75% of the said length. It has already been mentioned that it is also important for the shape of the channel to be wear resistant, so that even towards the end of the casting time the shape of the profiled section of the discharge channel remains sufficiently well proportioned in order to avoid a rotation of the stream and a generation of the "umbrella jet".

It is also recommended to keep the surface of the efficacious cross section with a certain ratio as compared to the surface of a standard cross section of a completely conventional teeming device. This cross section should not be less than about 40% of the standard cross section of a conventional outflow of a round cross section and it should not be greater than 120% of the said reference profile.

It has been established that the wear of those parts of the device, which do not comprise the shaped channel section for guiding the stream according to the teachings of the present invention, are not particularly critical. This is the case for example for the upper edge of the lower gate of a slide gate valve. If the area of the cross section of the inlet into the discharge channel section increases at this level, whereas the total length o the nozzle part remains of course constant, the slightly conical shape of the outflowing stream will be somewhat more important because it is widening out. There will, however, be no formation of an "umbrella jet" in this case. This is very favorable, due to the fact that the turbulence at the level of the transition of the metal from the upper gate with a round passage to the underlying gate with the star-shaped profile provided with 3–4 branches, the wear of the movable plates is more important than for the conventional devices. This wear will, of course, be less important if the sector constituting the entrance into the shaped outflow channel section remains circular. As already mentioned, this will not diminish the specific efficiency which shows itself through the hindrance of the rotation of the stream and through the suppression of the "umbrella" generation.

Whereas with conventional teeming device the bursting of the stream constitutes a constant danger, as a stream is always rotating in a round or in a polygonal discharge channel and as it is therefore liable to burst, this danger does not exist if a device according to the invention is used. First tests made in a steel shop in conjunction with the ingot casting of steel have immediately shown for the two first ingots of each heat a reduction of up to 50% of the surface defects consisting in scale, whereas for the complete heat the average of the reduction of the surface defects for all ingots was higher than 20%.

BRIEF DESCRIPTION OF THE DRAWINGS

Possible embodiments of the invention are shown in the joined figures.

FIG. 1 shows the profile of the triangular section, as well as the section of a star with three branches.

FIG. 2 shows the projection on the horizontal plan of an inferior movable plate with a round profile at the level of its entrance and with a star-shaped cross section at a lower level.

FIG. 3 shows a view similar to that of FIG. 2, except that the profile of the shaped discharge channel has the form of a cross. The cross section of the upper part 4 of the teeming device is normally unvarying and it has a round cross section.

DETAILED DESCRIPTION OF THE INVENTION

As shown in FIG. 1, the star-shaped channel profile is preferably provided with branch grounds 21, i.e. extremities of the radii, which are rounded out. Such bases of the branches can moreover be manufactured more easily by the refractory makers than the sharp edges 11 of a strictly triangular channel whose profile is delimited by the finer line 1. The three lateral sides of the shape represented by the heavier line 2 show concave recesses. The lateral striction 23 amounts to 2 to 4 mm as compared to the corresponding lateral wall of the equivalent strictly triangular profile 1. In both cases the radius or center line of one branch of the profile coincides with the axis of the relative movements of the parts of a slide gate valve with at least one movable part. In the illustrated embodiment the lower part 3 is movable and the center line of the right branch points into the direction of the sliding. In view of achieving the opening of the gates, the part 3 moves towards the fixed upper part 4, and its orifice 5 with a round passage.

On the left part of FIG. 2, it results clearly from the projection of the inferior plate 3 levels on the horizontal plan, that at least the few first millimeters of the upper part of the discharge channel show a circular cross section. However, the underlying part has the star-shaped cross section 2 which reaches down to the outflow level. In this case the guiding of the stream does not begin directly underneath the opening plate but at a slightly lower level and it continues down into the terminal shaped section of the nozzle.

FIG. 3 shows a view which is similar to that one of FIG. 2, except that the shaped cross section 6 of the discharge channel has the form of a cross. As shown in the figure, the extremities of the branches of the cross can be rounded out instead of having annular corners. In this case too the uppermost part of the discharge channel has preferably a round cross section 5 which changes into a cross-shaped section 6 at a slightly lower level. The diameter of the illustrated shape remains constant over the whole length of the profiled channel section, but the area of the round cross section at the entrance is slightly larger than the area of the cross at the outlet.

This new concept according to the invention has at least one additional advantage which plays an important part either during the rapid discharge of metal and of slag from metallurgical vessels or during the teeming of liquid metal from a container with a large surface area wherein the level drops rapidly. This is the case on the one side for the steelplant converters and on the other side for the continuous casting tundishes. The antirotational effect of the shape of the cross section according to the invention opposes the formation of a too important outflow vortex, As the vortex is not allowed to develop, there is no cone of slag or of air which is washed down through the center of the vortex and there is as a rule no need to stop the emptying at an early stage and to accept corresponding losses of metal and of productivity.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. A device for discharging liquid metal from a vessel comprising:

an elongated discharge member having an upper end and a lower end, said discharge member defining a discharge channel therethrough from the upper end to a discharge opening in the lower end, said discharge channel exhibiting, at least towards the discharge opening, a star shaped cross section, said star shaped cross section comprising a central opening having at least three branches extending radially outwards from the central opening; and gate means, transversely displaceable relative to said discharge member, for controlling the flow through said discharge channel, said gate means having a closed position in which the gate means closes the discharge channel and said gate means being displaceable in an open position in which the gate means opens the cross section of said discharge channel, wherein the star shaped cross section is oriented so that an extremity of one of said branches is first opened to the flow as the gate means is moved from said closed to said open position.

2. The device of claim 1, wherein the upper end of said discharge member has a profiled cross sectional shape which is substantially triangular and includes three branches wherein intersection of the center lines of the branches delimits obtuse angles.

3. The device of claim 1, wherein the star shaped cross section includes four branches wherein intersection of the center lines of the branches delimits right angles.

4. The device of claim 3, wherein intersection of the center lines of the branches defines angles of about 90° or greater.

5. The device of claim 1, wherein said discharge channel exhibits said star shaped cross section from the discharge opening along the majority of the length of the discharge channel.

6. The device of claim 5, wherein each of said at least three branches include an extremity having a radius which is rounded out.

7. The device of claim 1, wherein the discharge channel extends from an entrance opening to a discharge opening and the relative cross sectional area of the entrance opening and the discharge opening of the discharge channel define a ratio between about 1:1 and about 1:1.15.

8. The device of claim 1, wherein the cover means defines a second discharge opening, the discharge opening of the discharge channel and the second discharge opening are aligned when the gate means is in the open position and the relative cross sectional area of the second discharge opening the discharge opening of the discharge channel defines a ratio between about 1:1 and about 1:1.15.

9. The device of claim 1, wherein the upper end of said discharge member has a profiled cross section shape that is substantially circular.

* * * * *